US007186876B2

(12) United States Patent
Manton et al.

(10) Patent No.: US 7,186,876 B2
(45) Date of Patent: Mar. 6, 2007

(54) PROCESS TO PREPARE A PROCESS OIL

(75) Inventors: Mark Richard Stening Manton, South Wirral (GB); Marco Albert Henri Marie, Rognac (FR)

(73) Assignee: Shell Oil Company, Houston, TX (US)

( * ) Notice: Subject to any disclaimer, the term of this patent is extended or adjusted under 35 U.S.C. 154(b) by 602 days.

(21) Appl. No.: 10/257,110

(22) PCT Filed: Apr. 10, 2001

(86) PCT No.: PCT/EP01/04174

§ 371 (c)(1),
(2), (4) Date: Oct. 9, 2002

(87) PCT Pub. No.: WO01/77257

PCT Pub. Date: Oct. 18, 2001

(65) Prior Publication Data

US 2003/0121829 A1 Jul. 3, 2003

(30) Foreign Application Priority Data

Apr. 10, 2000 (EP) ..... 00400990

(51) Int. Cl.
*C07C 7/10* (2006.01)

(52) U.S. Cl. ..... 585/833; 585/804; 585/836; 585/838; 208/314

(58) Field of Classification Search ..... 585/319, 585/804, 833
See application file for complete search history.

(56) References Cited

U.S. PATENT DOCUMENTS

| | | | |
|---|---|---|---|
| 5,840,175 | A | 11/1998 | Aldous et al. |
| 5,853,569 | A | 12/1998 | Aldous et al. |
| 6,080,302 | A | 6/2000 | Aldous et al. |

FOREIGN PATENT DOCUMENTS

| | | | |
|---|---|---|---|
| EP | 0 417 980 | A1 | 3/1991 |
| EP | 0 950 703 | A2 | 10/1999 |

*Primary Examiner*—Tam M. Nguyen
(74) *Attorney, Agent, or Firm*—Charles W. Stewart

(57) ABSTRACT

A process to prepare a process oil with an aromatic content of more than 50 wt % (according to ASTM D 2007) and a polycyclic aromatics (PCA) less than 3 wt % (according to IP 346) by (a) contacting a feed mixture of a petroleum fraction boiling in the lubricating oil range and an aromatic rich hydrocarbon fraction with a polar solvent in a counter-current liquid-liquid extraction column, wherein the process oil is obtained by removing the polar solvent from the top product and an extract is obtained by removing the polar solvent from the top product and an extract is obtained by removing the polar solvent from the bottom product.

14 Claims, No Drawings

PROCESS TO PREPARE A PROCESS OIL

FIELD OF THE INVENTION

The invention relates to a process to continuously prepare a process oil with an aromatic content of more than 50 wt % (according to ASTM D 2007) and a polycyclic aromatics (PCA) less than 3 wt % (according to IP346).

BACKGROUND OF THE INVENTION

Process oils having the above properties are used in the preparation of rubber tires. For environmental and health reasons it becomes increasingly important to reduce the content of polycyclic aromatics in rubber tire products and therefore also in the process oils which are used for their preparation.

EP-A-950703 describes a process to prepare a process oil as described above. The process oil is prepared by contacting a mixture of a base oil and an aromatic rich extract with furfural as the polar solvent. The base oil is either obtained by hydrorefining or solvent refining. The aromatic rich extract is obtained by solvent extraction of a distillate fraction. This distillate fraction is obtained in a vacuum distillation of the residue of an atmospheric distillation of a crude oil. A disadvantage of this process is that the starting base oil is relatively expensive, when reviewing the numerous solvent or hydrorefining process steps to prepare the base oil.

Another process for preparing such a process oil is known from EP-A-417980. This publication describes a process in which first a petroleum fraction boiling in the lubricating oil range is extracted with a solvent, typically furfural or NMP. The extract mixture obtained is subsequently extracted with the same solvent in a second extraction step in which the process oil is obtained as the raffinate product.

The process of EP-A-417980 is either carried out in two extraction columns or in a so-called blocked-out operation in which the process oil is prepared in one and the same extraction column. In a blocked out operation the feed for the second extraction is first prepared and stored. The extraction column is subsequently prepared to perform the extraction of the stored extract mixture to obtain the process oil. Both schemes are disadvantageous. The first one because it requires an extra extraction column. The second option is disadvantageous because it requires significantly different operating conditions than those used for normal operation. Normal operation being the extraction of waxy distillate (fractions of the vacuum distillation) to make petroleum fractions poor in aromatics which are suitable for subsequent processing to make base oils. It would be desirable to use an existing solvent extraction unit to prepare the process oil. With the process according to this publication however switching between the two operating modes will be time consuming and laborious. Furthermore switching between the two production modes is likely to produce products that are unsuitable for subsequent processing to produce either base oils or the process oils, as described in EP-A-417980, that fall within the specifications of these products. It is therefore likely that these intermediate materials will have to be disposed of in other, less economical refinery streams, for example as the feedstock to a catalytic cracker.

An alternative route to the manufacture of process oils suitable for the application in rubber tires involves the extraction of a petroleum fraction boiling in the lubricating oil range which is extracted with furfural under "medium" severity processing conditions as described in Tire Technology International 1998. The disadvantage of this process route is that the "medium" severity operation differs from those normally used for the production of base oils. Thus when such a medium severity process would be used in an existing solvent extraction process problems will occur with regard to for example the throughput of heat exchangers resulting in clogging and other obvious problems.

U.S. Pat. No. 5,840,175 and U.S. Pat. No. 5,853,569 describe processes to prepare a process oil which can be used as rubber extender oils from naphthenic crude oils. A disadvantage of the processes as disclosed in these publications is that the content of aromatics in the process oil is low while the content of polycyclic aromatic compounds is relatively high. A further disadvantage is that the process comprises both hydrotreating steps and solvent refining steps. The present process aims at providing a process wherein additional hydrotreatment steps are not necessary.

SUMMARY OF THE INVENTION

Applicants have now found that with the following process the above disadvantages can be overcome. Process to prepare a process oil with an aromatic content of more than 50 wt % (according to ASTM D 2007) and a polycyclic aromatics (PCA) less than 3 wt % (according to IP346) by (a) contacting a feed mixture of a petroleum fraction boiling in the lubricating oil range and an aromatic rich hydrocarbon fraction with a polar solvent in a counter-current liquid-liquid extraction column, wherein the process oil is obtained by removing the polar solvent from the top product and an extract is obtained by removing the polar solvent.

DETAILED DESCRIPTION OF THE INVENTION

With the process according to the invention it has been found possible to prepare a process oil directly using the distillate fractions obtained in the vacuum distillation. Moreover, additional hydrotreatment steps are not necessary. Another advantage is that the process according the invention can be performed in an existing solvent extraction column of a lubricating base oil process, while minimising the transition period between the lubricating base oil mode of operation and the mode of operation of the present invention. A further advantage is that the existing heat exchangers and settlers of the existing process equipment can be used under throughput conditions which are similar to the base oil mode of operation. This is advantageous because this eliminates the necessity to install dedicated equipment for the production of the process oil. It has furthermore been found that the process oil obtained by the process according to the invention gives the same properties to the tire when compared to the process oil as obtained by the method as described in EP-A-417980.

The aromatic rich hydrocarbon fraction can be any hydrocarbon mixture containing aromatic compounds. Examples of refinery fractions which could be used in the present process are the heavy and light cycle oils obtained in a fluid catalytic cracking process. In order to meet a specific requirement of the tire industry with respect to viscosity of the process oil the aromatic rich fraction preferably has a kinematic viscosity at 100° C. from about 13 cSt to about 30 cSt, and more preferably from about 14 cSt to about 20 cSt. The aromatic content of the aromatic rich fraction is preferably from about 50 wt % to about 90 wt %. A suitable aromatic hydrocarbon fraction comprises the extract fraction obtained by removing the polar solvent from the bottom product of the present process. By recycling the extract fraction to the extraction column no intermediate storage of extract is needed.

A most preferred aromatic rich hydrocarbon fraction comprises the extract fraction obtained when removing aromatics by means of solvent extraction from a petroleum fraction boiling in the lubricating oil range in a process to prepare a lubricating base oil. In this preferred embodiment extract, preferably obtained when the same extraction column is used in the base oil mode of operation, is collected, stored and used when preparing the process oil according to the present invention. Although storage is needed a more robust process is nevertheless obtained. The aromatic rich fraction may also be a mixture of two or more of the above referred to examples of aromatic rich hydrocarbon fractions.

The petroleum fraction boiling in the lubricating base oil range is suitably obtained by first distilling a crude petroleum feedstock at atmospheric pressure and subsequently performing a vacuum distillation on the residue of the atmospheric distillation. The distillate products obtained in the vacuum distillation, also referred to as vacuum distillates, are the petroleum fractions boiling in the lubricating base oil range. The crude petroleum feedstock is preferably not a naphthenic crude. More preferably a crude feedstock is used comprising more paraffinic compounds, comprising preferably more than about 15 wt %, most preferably more than about 20 wt % of paraffins. Because of the more paraffinic character of the feedstock an additional dewaxing step will suitably be required. The fractions boiling in the lubricating base oil range have not been subjected to a solvent refining or hydro-refining. Solvent refining and hydro-refining are process steps to prepare a base oil product starting from the petroleum fractions boiling in the lubricating base oil range as for example described in Lubricant base oil and wax processing, Avilino Sequeira, Jr., Marcel Dekker Inc., New York, 1994, pages 2–4. The boiling range of the vacuum distillates are suitably between 300 and 620° C. and preferably between 350 and 580° C. Deasphalted residues of the above mentioned vacuum distillation are also considered to be the petroleum fractions boiling in the lubricating base oil rang according to this invention.

The feed mixture which is contacted with the polar solvent does not necessarily be mixed before being fed to the extraction column in order to obtain the desired process oil. However when using an existing solvent extraction column it is preferred to mix the two fractions beforehand and use the existing single feed inlet. Preferably the mass ratio of the petroleum fraction boiling in the lubricating base oil range and the aromatic rich fraction is between 3:1 and 1:3. More preferably the mass ratio is between 3:1 and 1:1.

The mass ratio of the polar solvent to the feed mixture is preferably between 3:1 and 1:1. High polar solvent to feed mixture ratios are used when the content of the aromatic rich fraction in the feed mixture is relatively high. When operating in the more preferred range of the feed mixture composition the polar solvent to the feed mixture is preferably from about 2.5:1 to about 1.5:1.

The temperature in the extraction column is an important operation condition in order to obtain the desired properties of the process oil. The temperature will be dependent on the composition of the feed, i.e. the content of aromatics, polyaromatics, and the choice of polar solvent. The temperature of the top product is preferably between 50° C. to about 90° C. and the temperature of the bottom product is preferably between 60° C. to about 80° C. These temperatures can be easily controlled by adjusting the temperature of the polar solvent and of the feed mixture.

When using an existing solvent extraction column as described above the polar solvent is typically removed from the bottom product by means of phase separation in a settler. Preferably the temperature in this settler is from about 40° to about 80° C. It will be understood that the temperature in the settler is equal or below the bottom product temperature and that the bottom product temperature is lower than the top product temperature.

The polar solvent can be any solvent which is capable of selectively removing aromatic compounds from a hydrocarbon fraction boiling in the lubricating oil range. Examples of these polar solvents are phenol, N-methylpyrrolidone and furfural, of which furfural is preferred.

The counter-current liquid-liquid extraction column may be any suitable liquid-liquid extraction vessel, for example a rotating disk contactor.

More preferably the process of the present invention is carried out in an existing solvent extraction process which is normally used to remove aromatic compounds from a hydrocarbon fraction boiling in the lubricating oil range. By making use of an existing solvent extraction unit considerable investment in a new unit will not have to be made. More preferably the existing process makes use of furfural as the polar solvent and the extraction column is of the rotating disk type. Examples of such existing solvent, furfural, extraction processes are described in general literature on base oil manufacturing, for example on pages 86–95 of Lubricant base oil and wax processing, Avilino Sequeira, Jr., Marcel Dekker Inc., New York, 1994. In a preferred embodiment the production of the process oil according to the present invention is performed alternatively with a process to prepare a lubricating base oil in the same extraction column in a so-called blocked out mode of operation. Preferably the aromatic rich extract obtained in the lubricating base oil mode of operation is stored and used as aromatic rich fraction in the process mode to prepare the process oil.

The process oil as obtained by the process according the invention is preferably dewaxed, especially when the feedstock to the present process is obtained from a more paraffinic crude petroleum feedstock. Suitable dewaxing processes are solvent dewaxing and catalytic dewaxing as for example described in "Lubricating base oil and wax processing", by Avilino Sequeira, Jr., 1994, Marcel Dekker Inc. New York, pages 153–224. Existing solvent dewaxing units are suitably used in combination with existing solvent extraction steps. An example of a suitable solvent dewaxing process is too cool the process oil together with a suitable solvent, for example methylisobutyl ketone/toluene or methyl ethyl ketone to a temperature of between −10 and −40° C. and subsequently filtering off the precipitated wax. Catalytic dewaxing can be performed by contacting the process oil in the presence of hydrogen with a suitable catalyst, preferably comprising SAPO-11, SAPO-31, SAPO-41, ZSM-5, ZSM-8, ZSM-11, ZSM-22, ZSM-23 and/or ZSM-35 and a Group VIII metal, preferably Pt, Pd, Ni or Co.

The invention shall be illustrated by the following non-limiting examples.

The examples should not be construed to limit the scope of the invention.

EXAMPLE 1

Preparation of the Aromatic Rich Fraction

In a counter current extraction column a hydrocarbon petroleum fraction boiling in the lubricating base oil range having the properties as listed in Table 1 was contacted with furfural. The hydrocarbon feed was fed to the bottom and the furfural was fed to the top of the column. The operating conditions are listed in Table 2, 1st column together with the most relevant results. The extract obtained after removing furfural from the bottom product is the so-called "aromatic rich fraction" to be used in the below examples according the invention. After removing furfural from the top product, the hydrocarbon fraction so obtained product poor in aromatics, had the properties to be further processed, i.e. by means of a dewaxing step, to a lubricating base oil.

TABLE 1

| | |
|---|---|
| Density (d70/4) | 0.908 |
| Refractive Index, 70 ° C. | 1.5092 |
| Viscosity at 100° C. ($mm^2/s$) | 14.14 |
| Viscosity at 120° C. ($mm^2/s$) | 8.391 |
| Aromatics, % wt | 62.7 |

EXAMPLE 2

Preparation of the Process Oil

An aromatic rich fraction was prepared in a commercial Furfural Extraction Unit, according to the process described in Example 1. Main characteristics of this extract are given in Table 3:

TABLE 3

| Aromatic-rich fraction: | |
|---|---|
| Density (d70/4) | 0.957 |
| Refractive Index, 70° C. | 1.5420 |
| Viscosity at 100° C. (cSt) | 21.3 |

TABLE 3-continued

| Aromatic-rich fraction: | |
|---|---|
| Aromatics (wt %) ASTM D2007) | 83.6 |
| PCA content (wt %; IP 346) | 15.8 |

A feed mixture of the petroleum fraction as used in Example 1 and of the above-described extract in a wt:wt ratio of 2:1 was contacted with furfural (in a mass ratio to the feed mixture of 1.50:1) in the same column as used in Example 1. The process conditions, temperatures used and properties of the thus obtained process oil are listed in Table 2.

EXAMPLE 3

Preparation of the Process Oil

Example 2 was repeated except that the mass ratio of the polar solvent to the feed mixture was increased from 1.5:1.0 to 2.0:1.0. The process conditions and properties of the thus obtained process oil are listed in Table 2.

EXAMPLE 4

Preparation of the Process Oil

Example 2 was repeated with a feed mixture of the petroleum fraction as used in Example 1 and the commercial extract described in Example 2 in a wt:wt ratio of 1:1. The process conditions and properties of the thus obtained process oil are listed in Table 2.

EXAMPLE 5

Preparation of the Process Oil

Example 4 was repeated except that the temperature of the settler was lowered to 50° C. The process conditions and properties of the thus obtained process oil are listed in Table 2.

TABLE 2

| Example | Example 1 | Example 2 | Example 3 | Example 4 | Example 5 |
|---|---|---|---|---|---|
| mass flow petroleum fraction (kg/h) | 1.00 | 0.67 | 0.67 | 0.50 | 0.50 |
| mass flow aromatic rich extract (kg/h) | 0.00 | 0.33 | 0.33 | 0.50 | 0.50 |
| mass flow furfural (kg/h) | 3.00 | 1.50 | 2.00 | 1.50 | 1.50 |
| top product temperature (° C.) | 113 | 80 | 80 | 80 | 79 |
| bottom product temperature (° C.) | 98 | 70 | 70 | 70 | 70 |
| temperature settler (° C.) | 80 | 70 | 70 | 70 | 50 |
| product properties of: | extract example 1 | process oil example 2 | process oil example 3 | process oil example 4 | process oil example 5 |
| WAXY PRODUCT: | | | | | |
| Yield (kg/h) | 0.50 | 0.66 | 0.60 | 0.67 | 0.72 |
| Density (d70/4) | 0.978 | 0.875 | 0.865 | 0.876 | 0.879 |
| Refractive Index, 70 ° C. | 1.5550 | 1.4845 | 1.4790 | 1.4850 | 1.4860 |
| DEWAXED (@ 20 ° C.)PRODUCT: | | | | | |
| Viscosity at 100° C. (cSt) (1) | 14.1 | 13.14 | 12.43 | 13.28 | 13.38 |

TABLE 2-continued

| | | | | | |
|---|---|---|---|---|---|
| Viscosity Gravity Constant (ASTM D2501) | | 0.895 | 0.843 | 0.855 | 0.859 |
| Aromatics (wt %) (ASTM D2007) | >90 (*) (*) :91.7%, as calc. from mass balance | 50.7 | 53.0 | 59.0 | 62.0 |
| PCA content (wt %; IP 346) | | 1.6 | <3 | 1.0 | <3 |

(1) Solvent dewaxing at −20° C.

We claim:

1. A process for preparing a process oil with an aromatic content of more than about 50 wt % and a polycyclic aromatics content less than about 3 wt % wherein said process comprises: utilizing a countercurrent liquid-liquid extraction column for the solvent extraction of a first petroleum fraction feedstock boiling in the lubricating base oil range to yield an aromatic rich hydrocarbon fraction; after the utilizing step, contacting a feed mixture, including a second petroleum fraction feedstock boiling in the lubricating oil range and said aromatic rich hydrocarbon fraction, wherein the mass ratio of the second petroleum fraction feedstock boiling in the lubricating oil range to the aromatic rich hydrocarbon fraction is between 3:1 and 1:3, and wherein the aromatic rich hydrocarbon fraction has a kinematic viscosity at 100° C. from about 12 cSt to about 30 cSt and an aromatic content of from about 50 wt % to about 90 wt %, with a polar solvent in the counter current liquid-liquid extraction column to produce a top product and a bottom product;) removing the polar solvent from the top product to obtain the process oil; and,) removing the polar solvent from the bottom product to obtain an extract.

2. The process of claim 1, wherein the mass ratio of the polar solvent to the feed mixture is from about 3:1 to about 1:1.

3. The process of claim 2, wherein the mass ratio is from about 2.5:1 to about 1.5:1.

4. The process of claim 1, wherein the temperature of the top product is from about 50° C. to about 90° C., the temperature of the bottom product is from about 60° C. to about 80° C. and wherein the polar solvent is removed from the bottom product by means of phase separation in a settler at a temperature of from about 40° C. to about 80° C., provided that the temperature in the settler is equal or below the bottom product temperature and that the bottom product temperature is below the top product temperature.

5. The process of claim 1, wherein the polar solvent is furfural.

6. The process of claim 1, further comprising dewaxing the process oil.

7. A process, comprising:

utlizing an extraction column for the solvent extraction of a first petroleum fraction feedstock boiling in the lubricating base oil range to yield an aromatic rich hydrocarbon fraction; and thereafter, using said extraction column for the solvent extraction of a feed mixture that includes said aromatic rich hydrocarbon fraction and a second petroleum fraction feedstock boiling in the lubricating base oil range to yield a process oil having an aromatic content of more than about 50 wt % and a polycyclic aromatic content of less than about 3 wt %.

8. A process as recited in claim 7, wherein a feed mass ratio of said second petroleum fraction feedstock to said aromatic rich hydrocarbon fraction charged to said extraction column in the solvent extraction of said feed mixture is in the range of from 3:1 to 1:3.

9. A process as recited in claim 8, wherein the solvent extraction of said feed mixture includes contacting said feed mixture with a polar solvent and yielding a top product from which said process oil is recovered.

10. A process as recited in claim 9, wherein a polar solvent mass ratio of said polar solvent to said feed mixture charged to said extraction column in the solvent extraction of said feed mixture is in the range of from 3:1 to 1:3.

11. A process as recited in claim 10, wherein said polar solvent is selected from the group consisting of phenol, N-methylpyrolidone and furfural.

12. A process as recited in claim 11, wherein said aromatic rich hydrocarbon fraction has a kinematic viscosity at 100° C. in the range of from 13 cSt to 30 cSt and an aromatic content in the range of from 50 wt % to 90 wt %.

13. A process as recited in claim 12, wherein said first petroleum fraction feedstock and said second petroleum fraction feedstock are obtained by the atmospheric distillation of a crude petroleum feedstock and the vacuum distillation of the atmospheric residue thereof to yield a petroleum fraction boiling in the lubricating base oil range of from 30° C. to 620° C. that is suitable for use as said first petroleum fraction feedstock or as said second petroleum feedstock, or both.

14. A process as recited in claim 13, further comprising: dewaxing said process oil to thereby provide a dewaxed process oil.

* * * * *